US008336174B1

(12) United States Patent
Johnson

(10) Patent No.: US 8,336,174 B1
(45) Date of Patent: Dec. 25, 2012

(54) COMMEMORATIVE URN DISPLAY DEVICE

(76) Inventor: Darnell L. Johnson, Lemon Grove, CA (US)

( * ) Notice: Subject to any disclaimer, the term of this patent is extended or adjusted under 35 U.S.C. 154(b) by 0 days.

(21) Appl. No.: 13/163,566

(22) Filed: Jun. 17, 2011

(51) Int. Cl.
*A61G 17/00* (2006.01)

(52) U.S. Cl. ..... 27/1; 40/124.5

(58) Field of Classification Search ..... 27/1; D99/5; 40/124.5, 409; 428/542.4
See application file for complete search history.

(56) References Cited

U.S. PATENT DOCUMENTS 5,896,632 A * 4/1999 Sturino ..... 27/1
5,987,720 A * 11/1999 Yamamoto ..... 27/35
6,665,916 B1 * 12/2003 Santorello et al. ..... 27/1
7,082,653 B1 * 8/2006 Sueppel ..... 27/1
7,117,570 B1 * 10/2006 Borgerding ..... 27/1
7,373,703 B1 * 5/2008 Grenci ..... 27/1
7,861,385 B1 * 1/2011 Meyer ..... 27/1
2005/0071964 A1 * 4/2005 Vogel et al. ..... 27/1
2007/0220788 A1 * 9/2007 McCray ..... 40/124.5
2010/0199476 A1 * 8/2010 Cummings et al. ..... 27/1

* cited by examiner

*Primary Examiner* — William L. Miller
(74) *Attorney, Agent, or Firm* — Donn K. Harms

(57) ABSTRACT

An urn display device for commemorating and honoring a deceased individual. The device features an urn body formed of substantially transparent material. Cavities forming indicia viewable through the urn body are formed and can include one or a combination of an image, text, or a facial depiction of the deceased, or combination thereof, as a means to employ customized indicia on the urn body to honor said deceased. The media to enhance viewing ability of the indicia includes or is supplemented by the deceased's ashes.

4 Claims, 4 Drawing Sheets

COMMEMORATIVE URN DISPLAY DEVICE

BACKGROUND OF THE INVENTION

1. Field of the Invention

The present invention relates to urns employed conventionally as a resting place for a deceased's ashes. More particularly the device relates to a commemorative urn employing the ashes themselves for the formation of readable indicia thereon which is imparted in a manner or relating to an event which personally celebrates the life of the deceased.

2. Prior Art

It is common to honor and commemorate the deceased often through the use of cremation urns. Cremation is a conventionally desired alternative for many people to a ground burial, for both personal as well as religious reasons. Subsequent to a conventional cremation, the deceased's ashes are placed in a sealed, often decorative, urn and provided to relatives who place the urn in view as a symbol of commemoration of the person represented. As such, loved ones of the deceased take great care in choosing style or type of urn.

However, a majority of funeral urns available for purchase, although decorative, on their exterior, do nothing to specifically honor an individual therein, aside from a name plate or the like. They are simple ceramic or glass or other materials and are colorized or have decorative indicia thereon with little or no meaning relating to the interned deceased.

Furthermore, conventional and especially customized urns if requested, can be quite costly to the buyer due to the nature of the industry and its lack of customization ability for the ceramic and glass products. The cost and the inavailability as such, can prevent a loved one from obtaining the urn they feel will properly and best celebrate and honor the life of their deceased loved one. This is an unwanted and unneeded problem to surmount for such parties during the hardship they have already associated with the passing of relative, friend, or other loved one.

Examples of customized urns are seen in U.S. Pat. No. 7,174,611 to Rose et al. and US. Pat. App. Pub. 2010/0212124 to Denton et al. However these as well as many other prior art urns are not easily modifiable to celebrate and provided indicia representative of one or a plurality of personal traits or related subjects which specifically relate to and honor an individual.

As such there is a continuing and unmet need for a commemorative urn device configurable in a manner with decorative indicia celebrating the life of the deceased. Such an urn device should be easily customizable to specifically identify the deceased entombed such as through images and text. Further, such a customizable urn device in addition to easy customization, should be inexpensive to produce in order to allow persons of limited income to provide a final resting place for their loved ones at an affordable cost. Still further, such an urn device should be easily modified and customizable to provide indicia thereon which provides a representation of an important aspect of the individual's life such as their job, or organizations in which they were members, or awards they received, or indicia providing a representation to viewers of other individual characteristics and traits of the deceased as needed for proper commemorations. Finally such an urn device, should endeavor to use, at least partially, the ashes of the departed person to provide a darkened media to fill said cavities and enhance the viewable indicia to viewers, while concurrently maintaining those ashes in a secure cavity where they will remain for eternity.

SUMMARY OF THE INVENTION

The device herein disclosed and described provides a solution to the shortcomings noted in prior art and achieves the above noted goals through the provision of an urn device and method for commemorating the deceased which is highly customizable with virtually any indicia, and at a cost allowing people at all income levels to make such a purchase. The device generally includes a substantially transparent display body forming the wall surface of the urn, with internal cavities therein which are formed to hold the deceased ashes or a darkened media, such as a black powder, or ground charcoal, if ashes are not desirable or available for some reason.

The wall surfaces of the internal cavities may be cut or formed into indicia resembling an image, text, photo, illustration, or a combination of indicia which relate to or commemorate one or a plurality of the aspects to the deceased's life. The cavities may be cut with a laser, or machined, or otherwise formed on the interior wall surfaces using machine tools or the like. Once the internal cavities are formed in shapes and dimensions to match the desired indicia and depictions which the purchaser chooses as appropriate, the urn device is formed with the customized indicia defined by the wall surfaces of the internal cavities formed.

However, at this point, because the walls are substantially transparent, the indicia is not easily discerned by third parties.

To render the indicia easily readable and discernable, the device further includes a means to fill the formed internal cavities defining the viewable indicia, with the deceased's cremated remains. The addition of the darkened media, such as at least partially the deceased's ashes, to the internal cavities of the transparent wall surfaces, render the indicia more pronounced wherein the image or text is easily visible to a third party viewing it through the transparent side walls of the urn.

In a particularly preferred mode the urn display body is rectangular with substantial thickness dimensionally so as to stand upright on it own. The display body of the urn so formed, consists generally of two portions each having exterior surfaces and mating surfaces for attachment employing a means for cooperative engagement to thereby form the final urn display body.

The engaging surfaces of the half portions of the assembled urn, include recess cavities or engravings of one or preferably both the respective halves which form indicia when viewed through the wall by viewers. The indicia so viewed provides a display of one or a combination of images and text which the buyer may provide the urn maker to form the indicia in a manner which relates to and celebrates the life of the deceased. Such could be for instance a rendering of their badge if the deceased is a fireman or policeman, or a rendering of the deceased's face from a photo, or other indicia relating to the deceased.

Once the cavities are formed to shapes and dimensions to reproduce the requested indicia provided by the buyer, the two halves of the urn body may be engaged. Upon this engagement of the plurality of portions of the display body of the urn, an enclosed cavity or plurality of cavities are formed in a rendering of the engraved or carved image and/or text. When multiple cavities are formed, they are formed in a manner to communicate with each other and a filler channel to allow the placement of ashes therein. The display body includes one or a plurality of such fill channels wherein crematory remains of the deceased can be poured to fill all of the formed interior cavities of the formed indicia to render any images and text when viewed through the transparent walls of the urn, more easily distinguishable.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

It is an object of the invention to provide a commemorative urn display device for individualized memorialization.

It is an object of the invention to provide a commemorative urn display device employing engraved, laser formed, carved, or otherwise cavities which define images and text to viewers and which provide a resting place for crematory ashes.

It is an object of the invention to provide a custom image and text that is personally representative of the deceased being honored.

Finally, it is another objet of the invention to at least partially employ the ashes of the deceased to render the images and lettering and other indicia formed in the device, legible to the viewer.

These together with other objects and advantages which become subsequently apparent, reside in the details of the construction and employment of the urn as herein described with reference being had to the accompanying drawings forming a part thereof, wherein like numerals refer to like parts throughout.

BRIEF DESCRIPTION OF DRAWING FIGURES

DETAILED DESCRIPTION OF THE PREFERRED EMBODIMENTS OF THE INVENTION

Figure 1:
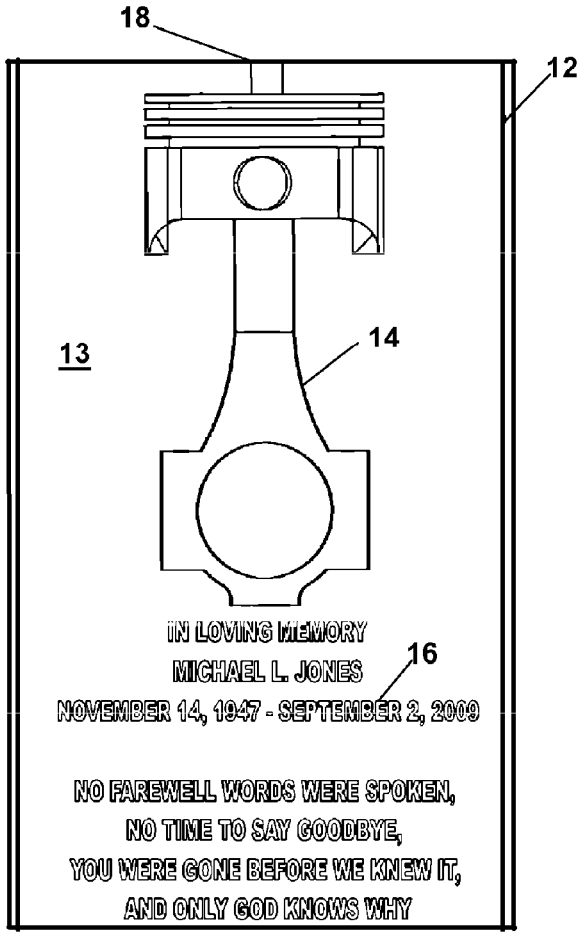
FIG. 1 shows a front view of a first body portion of the device depicting engraved text and image into the body prior to placement of a darkened media and/or ashes therein.

Now referring to drawings in FIGS. 1-5, wherein similar components are identified by like reference numerals, there is seen in FIG. 1 a frontal view of the first body portion 12 of the device 10. The first body portion 12 is substantially a transparent material such as a plastic, glass, plexiglass, acrylic, or the like which is easily machined using tools, or laser or other cutting tools and operations.

In all modes of the device 10, when it is formed by a seller, the body portion 12 may include one or a combination of indicia including an image 14 formed on a first surface 13 of the body portion 12 and into the depth of the body wherein a substantial cavity of the image 14 is provided or text 16 also formed in a manner and depth to form cavities which communicate with each other to allow for filling with material after formation.

The means for forming the cavities forming the indicia for an image 14 may be any means known in the art such as carving, milling, or laser or tool based engraving or other such means which may be conventionally computer controlled by an engaged computer using software adapted to the task, of directing the cutting or carving tools to precisely form the cavities based on a photo or drawing of the image 14 or chosen text 16. Such computer controlled mills and routers and lasers and similar cutting means capable of forming the cavities to render the indicia are readily available commercially and well known to those skilled in the art.

The employment of computer controlled cavity formation for indicia rendering for images 14 provide a means for the present invention to allow for the formation of indicia of images 14 which are highly specific to the deceased, and which may individually identified and honor the deceased. Such image indicia for instance might be a badge rendering if the deceased is a peace officer or fireman, or a three dimensional rendering of the face of the deceased, or a piston if the deceased was a mechanic or race car driver. This personalized indicia formation is a highly preferred mode of the device 10 herein because it solves one of the noted shortcomings of prior art through the provision of highly customizable indicia honoring of the deceased which may be personally individualized at a reasonable cost, in a short time frame, yielding decorative urns not achieved by urns and other display devices presently known.

For example as depicted in the figure the indicia in FIG. 1, is formed by cavities to render an image 14 shown resembling a typical piston of an internal combustion engine insofar as the deceased may have been a mechanic or had a general fondness for cars. It must be noted that the indicia forming images 14 in the device 10 can be one of nearly an infinite number images that may represent, honor, or identify an individual, therefor it is not within the scope of the disclosure to distinctly and specifically disclose each and every possibility. As such those skilled in the art will appreciated that the machining of the device to form cavities for holding dark media such as powder or charcoal or preferably the deceased's ashes which render the image 14 shown in the figures, is done so merely for demonstrative purposed and should not be considered limiting in the intended purpose of the present invention.

As noted, the indicia provided by the cavities machined into the half or halves of the device 10 may further includes text 16 formed using computer controlled or hand controlled cutting means, in a manner similar to the images 14 formed in the body portion 12 of the device 10 by a cutting means to remove sufficient material in proper positions to yield cavities to render the indicia as text 16. The text 16, like the images 14, which may be formed in an infinite variety, provide a means for custom and unique indicia formation in the device for identification, honoring, and remembering the deceased. As such it again must be noted that the text 16 depicted in the present invention may vary from that depicted infinitely, in this and following figures while those depictions set forth are done merely for demonstrative purposes of the intended scope of the invention. It should also be noted that while a computer controlled cutting device will form cavities to render the desired indicia for one or both of images 14 and text 16, a steady hand of a good artist using such cutting tools may also be employed to form the same in a slower fashion. The formation of indicia which are also cavities for holding ashes is a primary objective no matter how formed, to allow the actual ashes of the deceased to render the indicia easily readable.

Figure 2:
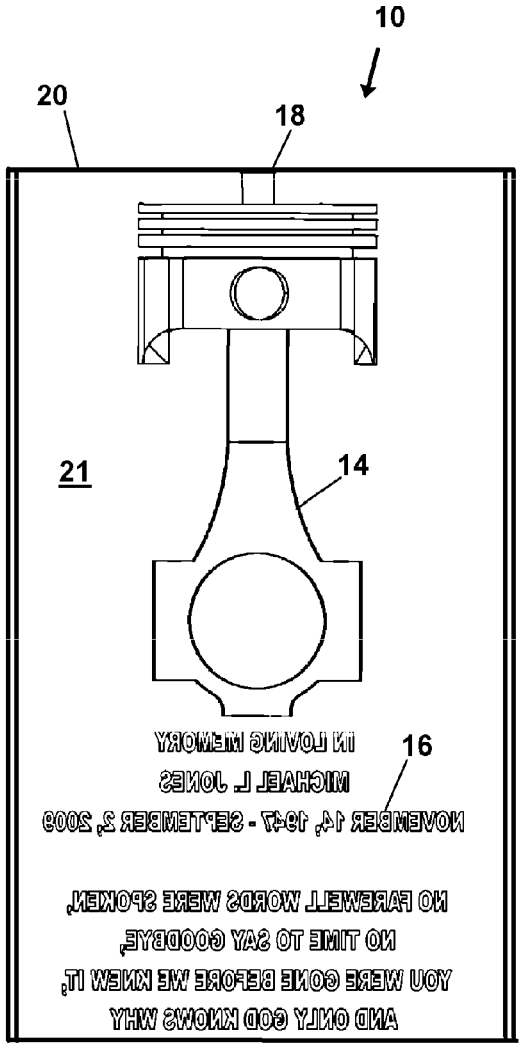
FIG. 2 shows the rear of FIG. 1, covered with a second body portion of the device and depicting the mirrored engravings of the text and images of the front view of FIG. 1.

Additionally included in the device 10 is a second body portion 20 as shown engaged to the back of FIG. 1, in FIG. 2. The second body portion 20 may simply be a planar piece of transparent material to cover the formed cavities rendering the indicia in the first body portion if the indicia is only to be viewed from the front of the device 10 through the first body portion 12. However if a viewing of the image 14 is desirable through both body portions, the cavities forming the indicia of the image 14 in the first body portion 12, may also be formed in alignment with and in a manner to mirror the image 14 to thereby yield a more three dimensional image 14 stretching between both cavities.

The formation of rearward readable text 16 as shown in the first body portion 12 would of course be viewed backwards through the second body portion 20 if aligned and mirrored. Therefor any formation of cavities in the second body portion 20 for text viewable therethrough needs to be done in anticipation that the cavities forming all the indicia, will be filled with flowing media such as dark sand or charcoal grounds, which will flow through, out of alignment with the indicia forming the text 16 in the first body portion 12, but it can be done in the same fashion as noted above.

Formation of the finished device 10 having internal cavities formed to render indicia readable through the first body portion 12 and second body portion 16 is provided when the first body portion 12 and second body portion 16 are permanently engaged by a means of engagement via adjacent abutment of the respective first surfaces 13, 21. The engagement allows for indicia formed by the cavities therein to render a viewable image 12 and text 16 formed by the 3 dimensional cavities forming enclosures within the combined bodies 12, 20 of the device 10. The means of engagement of the two portions may be any means known in the art such as adhesive, screw type, bolt type, etc.

Additionally formed in the machining process to form the cavities which render the indicia is one or a plurality of fill channels 18. The fill channel 18 formed is employed for introducing the deceased's ashes, or another dark flowable media such as ground charcoal or dark powder, or combinations thereof, into the fill cavity 18 of the enclosures defined by the combined cavities forming indicia of either image 14 and text 16 in the first and second body portion 12,20. All of the cavities defining the enclosures which form indicia for any image 14 and any text 16, must be in a direct communication with a channel 18, or in an indirect communication therewith, through one or a plurality of connected cavity-defined ash enclosures. This allows the ashes, or other flowing preferably dark media, to be placed into the channel 18, and the device shaken, until the flowable media or ashes fill all of cavities forming text 16 or images 14.

Once so filled, the images 14 and test 18 which were possibly viewable with great effort, with the viewer within inches of the device 10, become easily viewed and discerned from a normal distance of 2-5 feet, depending on the viewer's eyesight.

In a another particularly preferred mode of the device, the second body portion 20 may include a smooth first surface 21 without respective cavities to form an image 14 and text 16. In this mode the second body portion 20 merely provides a means to enclose the cavities of the image 14 and text 16 of the first body portion 12. The fill channel 18 may not be required in this mode since the cavities defining the image 14 and text 16 indicia, all communicate with the rear surface of the first body portion 12 and may be filled directly.

Figure 3:
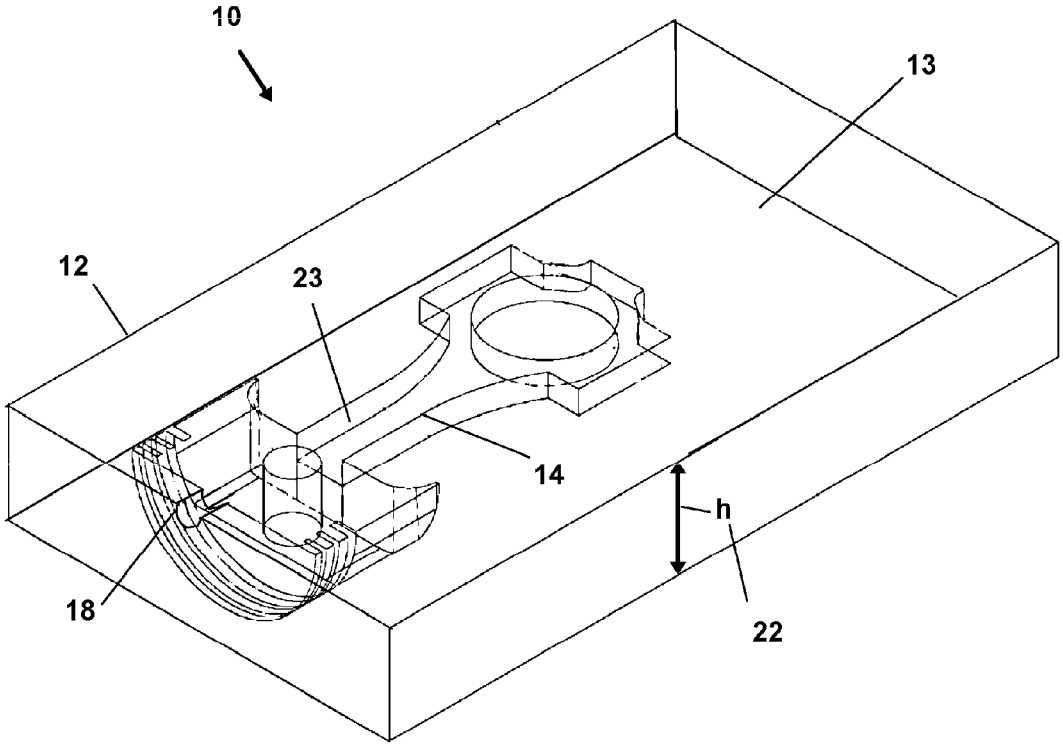
FIG. 3 is an elevated view of the first body portion of the device showing the cavity of the engraved image of a piston, for filling with crematory ashes.

To better depict the cavity formed within the body of the device 10 there is shown in FIG. 3 an perspective view of the first body portion 12 with the cavities formed to render text 16 omitted for clarity. Depicted in FIG. 3 are the computer controlled tool-formed cavities such as the substantial cavity 23 forming part of the image 14 formed into the first surface 13 of the body portion 12 into the depth 22 of the body portion 12. As noted the cavities which might render text 16 have been omitted insofar as the cavities rendering the text 16 (not shown) are similarly formed within a depth 22 of the body portion 12 of the device 10. As such the depiction of FIG. 3 is shown is merely for purposes of demonstrating the operative hand or machine forming of cavities to render the customized indicia as is within the intended scope of the device 10.

The fill channel 18 is shown providing a means to communicate between the exterior of the device and the cavity 23 of the image 14 upon operative positioning of crematory remains into the completed assembly of the device 10. As noted, all cavities forming indicia must directly or indirectly communicate with the fill channel 18 to allow for a communication of the dark media and/or ashes to all the cavities. Similarly as noted previously in the other particularly preferred mode of the device 10, the second body portion 20 include cavities formed in mirror image 14 of the that of the first body portion 12.

Figure 4:
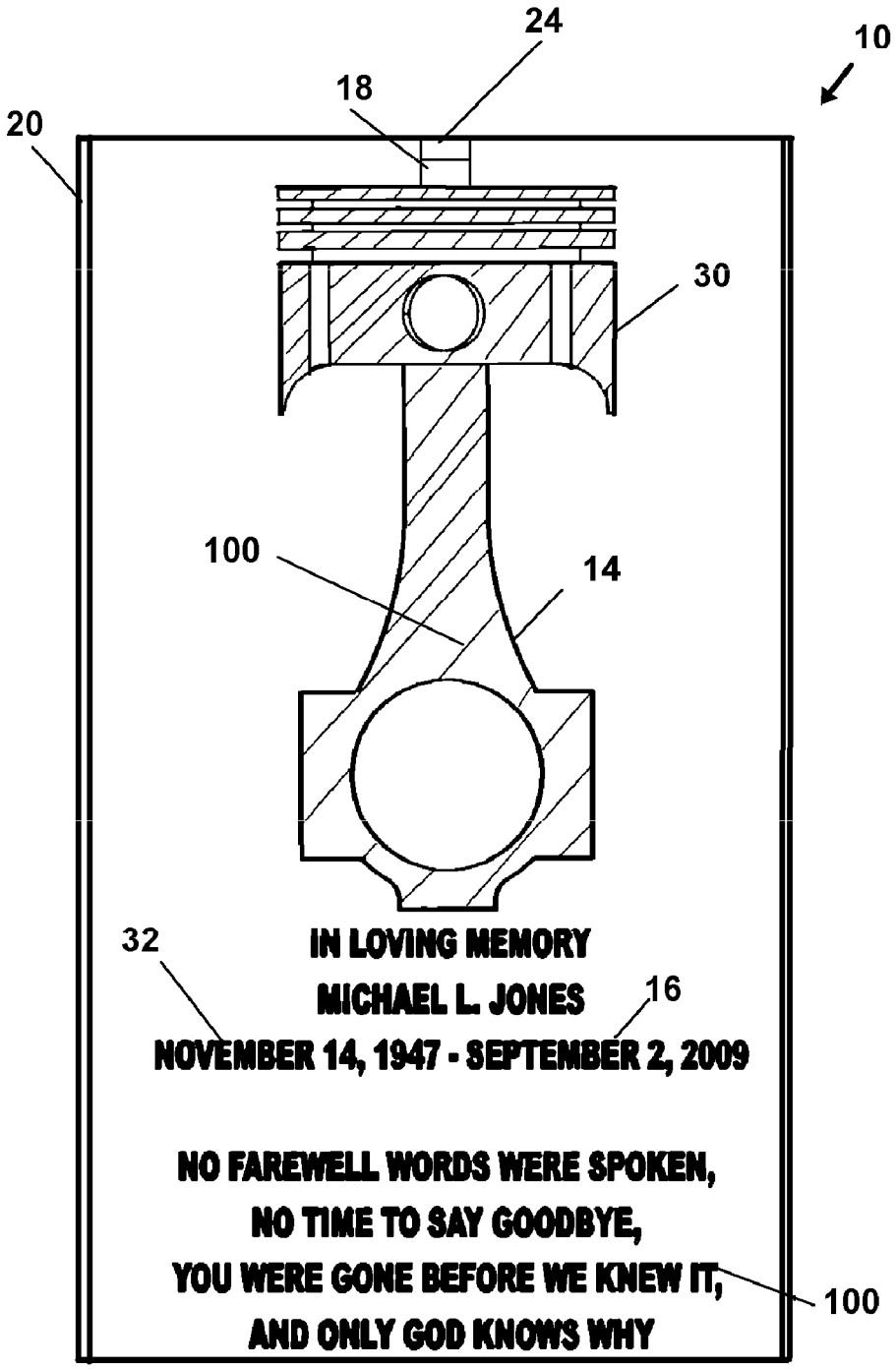
FIG. 4 depicts a front view of the complete device through the wall of the first body portion, with the indicia enhanced by the placement thereon of a dark media or particulate such as at least partially crematory ashes.

FIG. 4 shows a front view of the device 10 in operative mode, wherein the second body portion 20 is engaged over the first body portion 12 such that the cavities of the image 14 and any rearward projecting forward facing extensions of text 16, are cooperatively engaged forming internal 3D display cavities 30, 32 of the display device 10. As shown in the as-used mode in the FIG. 4, the cavities 30, 32 of the image 14 and text 16 respectively have been filled with dark media such as ground charcoal, dark powder, sand, or crematory ashes 100 or combinations thereof, through the fill channel 18, such that the rendering of the indicia of both the image 14 and text 16 are made discernable in the transparent material. They will appear as three dimensional images when so viewed and can be discerned easily from 2-5 feet away from the device 10. This enhanced ability to view the indicia is provided predominantly by the deposited flowing media or ashes deposited in one or a plurality of the cavities 18, and as depicted, can now easily viewable as indicia, through the transparent body portions 12, 20 of the device 10. The ashes of the deceased, alone or in combination with a dark media, provide the medium to render the indicia formed in the transparent material of the device 10, discernable, especially from a distance of more than a foot and out to five feet. This is because formed indicia in the transparent material is primarily a void therein absent of color. Absent a transmission and refraction of light through the body of the device renders the indicia viewable, or in a low light environment, is hard at best to discern absent the deposit of ashes therein.

It is therefor particularly preferred in making the device 10, that the cavity or cavities forming images 30 or text 16 or other formed indicia, be filled with dark media or ashes or combinations thereof, via the needed amount of fill channels 18 which as noted communicate with all internal cavities forming indicia either directly or through adjacent indicia forming cavities.

Once filled operably, the channel 18 is operatively sealed using a means to close the channel 18 and prevent leakage therefrom or from the cavity 30, such as a cap 24. The means of engagement of the cap 24 within the channel 18 can be any means known in the art such as screw type, frictional engagement, or permanent engagement. Alternatively, if the cavities forming indicia defining text are not interconnected to the channel 18, it is particularly preferred that the cavity 32 defining text be filled prior to engagement of the first body portion 12 to the second body portion 20.

Figure 5:
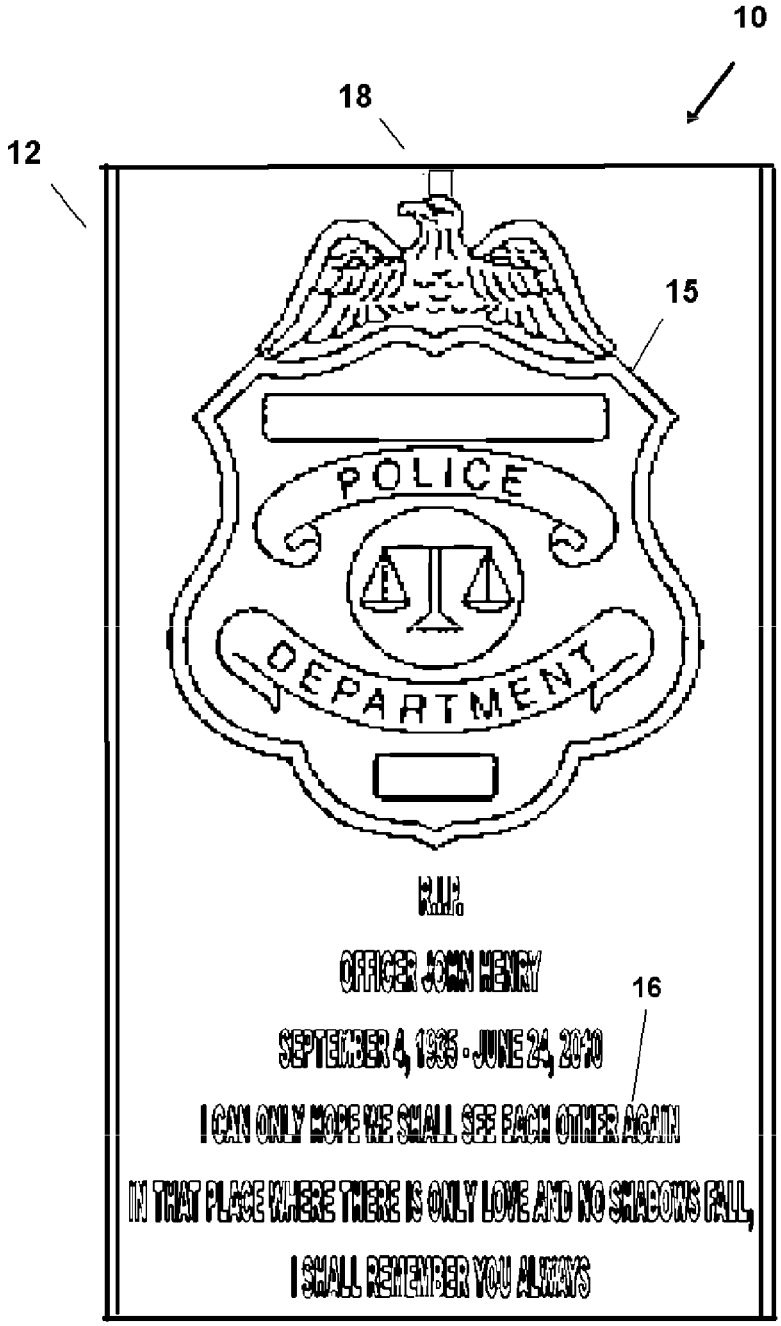
FIG. 5 shows another view through the first body position of the device depicting an alternate engraved image to show that virtually any image may be formed using appropriate tools and components.

FIG. 5 is a depiction of the device 10 employing cavities to form indicia of another possible image 15 representative of the personalization capability of the device through identification of the honored deceased. As noted it is within the scope of the invention and an advantage over prior art to provide a means to form indicia in the device 10 which individually represents, honors, or identifies the deceased through personalized images and text. The easy and fast ability for customization of the present invention can be easily employed via the above noted operative forming of the appropriate cavities to yield such images and text within the body portions of the device 10 providing a series of three dimensional cavities in which crematory remains, known as ashes, may be introduced to provide the enhanced visual discernment of the indicia in the form of letters and images which prior to such introduction remained substantially indiscernible due being formed of voids in transparent material.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. An urn display device for commemorating and honoring a deceased individual, comprising:

a display body formed of a first display portion and second display portion formed of substantially transparent material;

said first display portion including one or a plurality of recessed cavities formed a depth into a first surface of said first display portion;

said cavities forming indicia viewable through said display body, said indicia including an image, text, a facial depiction of the deceased, or combination thereof as a means to employ customized said indicia as an honor to said deceased;

said second display portion having a second surface thereon configured to sealably mate with said first surface of said first display portion;

said second display portion including one or a plurality of secondary recessed cavities formed a distance into said second surface of said second display portion, said secondary recessed cavities in said second portion defining secondary indicia resembling said image, text, a facial depiction of the deceased, or combination thereof;

means for an engagement of said first surface of said first display portion to said second surface of said second display portion;

said secondary indicia, providing an extension of said indicia formed in said first display portion extending rearward into said second display portion, and appearing as a part of said indicia within said first display portion, when said first and second display portions are in said engagement; and said engagement forming said substantially transparent display body wherein said cavities of said first display portion and said secondary cavities of said second display portion define said image, text, a facial depiction of the deceased, or combination thereof within said display body from outside said display body.

2. The urn device of claim 1, additionally comprising:

means to communicate flowable darkened media to fill said cavities and said secondary recessed cavities; and said darkened media providing an enhanced rendering of both of said indicia and secondary indicia when viewed from said outside of said display body through material forming said display body, from a distance.

3. The urn device of claim 2, additionally comprising:

said darkened media comprised of at least partially, by ashes of the deceased.

4. The urn device of claim 2, additionally comprising:

said distance being up to 5 feet.

* * * * *